United States Patent [19]

Blackburn

[11] Patent Number: 4,884,256

[45] Date of Patent: Nov. 28, 1989

[54] DIAL FACE FOR CLOCK OR WATCH

[75] Inventor: Bruce N. Blackburn, Pelham, N.Y.

[73] Assignee: Bernard Weinstein, New York, N.Y.

[21] Appl. No.: 260,411

[22] Filed: Oct. 20, 1988

[51] Int. Cl.[4] ..... G04B 19/00

[52] U.S. Cl. ..... 368/223; 368/294; 368/296; 368/228; 368/232

[58] Field of Search ..... 368/223–230, 368/231–238, 294–296; D10/6, 126

[56] References Cited

U.S. PATENT DOCUMENTS

| | | | |
|---|---|---|---|
| 69,193 | 1/1926 | Whitehead . | |
| 140,234 | 2/1945 | Thompson | D42/10 |
| 151,204 | 10/1948 | Adamson | D42/10 |
| 198,577 | 7/1964 | Lavitol | D42/1 |
| 250,004 | 10/1978 | Quigley et al. | D10/74 |
| 282,723 | 2/1986 | MacNeal | D10/1 |
| 360,641 | 4/1887 | Adam . | |
| 2,023,934 | 4/1935 | Moise | 58/50 |
| 2,168,314 | 8/1939 | Blanks | 58/126 |
| 2,188,872 | 1/1940 | Carlson | 58/126 |
| 3,177,646 | 4/1965 | Ernest et al. | 58/2 |
| 3,952,500 | 4/1976 | Tomura | 368/229 |
| 4,094,464 | 6/1978 | Kawamura et al. | 368/223 |
| 4,241,442 | 12/1980 | Grohoski | 368/294 |
| 4,497,312 | 2/1985 | Byrd | 128/1 R |
| 4,702,616 | 10/1987 | Kizawa | 368/223 |
| 4,706,238 | 10/1987 | Kizawa | 368/296 |

FOREIGN PATENT DOCUMENTS

| | | | |
|---|---|---|---|
| 43831 | 12/1971 | Japan | 368/229 |
| 338401 | 6/1959 | Switzerland | 368/232 |
| 450298 | 4/1968 | Switzerland | 368/232 |
| 772228 | 4/1957 | United Kingdom | 368/229 |

*Primary Examiner*—Bernard Roskoski
*Attorney, Agent, or Firm*—Pennie & Edmonds

[57] ABSTRACT

An apparatus for indicating time featuring a face having members positioned around a central point in five minute time intervals thereby forming a continuous surface, a pair of hands which rotate relative to the members and a means for mounting to a watchband, a wall or other such surface. These members may form a variety of different size and shape perimeters for the face. Also, the members may converge to the central point or terminate prior to that point to form a closed area.

34 Claims, 4 Drawing Sheets

DIAL FACE FOR CLOCK OR WATCH

TECHNICAL FIELD

The invention relates to a timepiece, in particular to a watch or clock having a distinctive three dimensional face.

BACKGROUND ART

Various ornamental watches have been developed whereby the face of the watch has an artistic quality. Typical examples of such watches or watch faces can be found in U.S. Pat. Nos. 140,234 (clock dial); 151,204 (watch dial) and 282,723 (clock). With the exception of the last reference, all of these and many other ornamental watches rely on numerals or at least one other indicia to assist in time telling.

None of these prior art timepieces exhibit the three dimensional qualities of the invention and are capable of clearly and accurately indicating time solely by the construction of their faces.

SUMMARY OR THE INVENTION

The present invention relates to an apparatus for indicating time comprising a face having members arranged in a predetermined pattern around a central point thereby forming a continuous surface and means for determining elapsed time. The members may be arranged to represent predetermined time intervals, preferably twelve members each representing a five minute interval. Hands which rotate around the face relative to the members may be used as the time determining means. Means for sequentially illuminating the members or a combination of hands and illumination means may similarly be used.

The face and time determining means may be protected from external sources by use of a crystal which is configured to securely attach to said face. Also, the invention may be supplied with means for attachment to a support member. Such means may include a pair or posts for mounting a watchband or, a hook or recess for securing the invention to a wall or other surface.

The interior pattern of the watch may vary such that the member of the face converge to the central point or terminate, prior to intersection at the central point, to form a closed area. Similarly, the perimeter of the face may have several configurations. For example the perimeter may be substantially circular, rectangular, or rectangular with rounded edges.

BRIEF DESCRIPTION OF THE DRAWINGS

Further benefits and advantages of the invention will and become apparent from a consideration of the following description given with reference to the accompanying drawing figures which specify and show preferred embodiments of the invention, and wherein.

DETAILED DESCRIPTION OF THE PREFERRED EMBODIMENTS

Figure 1:
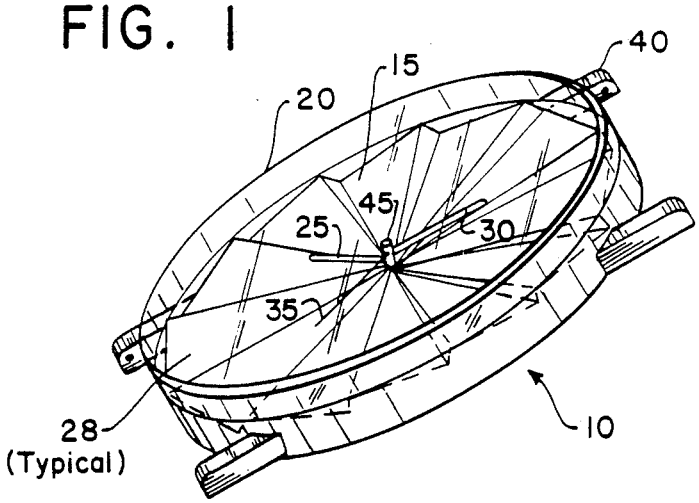
FIG. 1 is perspective view of a watch having a face according to the invention with a circular perimeter.
Figure 2:
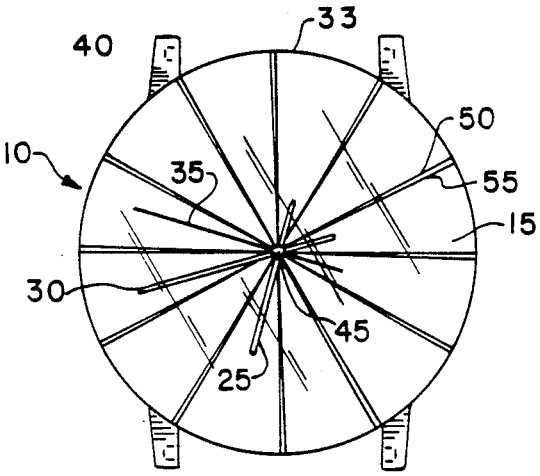
FIG. 2 is a front view of the watch of FIG. 1.
Figure 3:
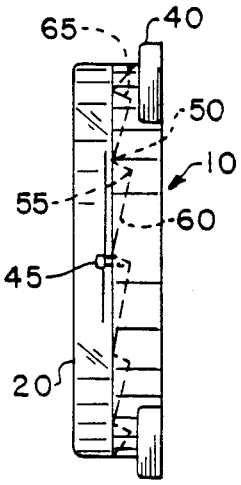
FIG. 3 is a side view of the watch of FIG. 1.

Referring now to FIGS. 1–3 there is illustrated an apparatus for indicating time substantially in the form of a watch 10 comprising a circular face 15, matching crystal 20, hour hand 25, minute hand 30, second hand 35, central portion or stem 45 and pair of posts 40 for attaching a watchband. Although the invention is described with respect to a wristwatch, other forms of timepieces are included in this invention, such as pendants, clocks, timers sundials, and the like.

The circular face 15 of the watch 10 includes a plurality of members 28 (typical), which are tilted at an angle with respect to a horizontal plane and which are joined around a central point in a cascading or stepped relationship to form a continuous surface. In the most preferred embodiment, twelve members are arranged such that each member represents a five minute interval, however this is not critical to the design. For example, time intervals of numerical divisions of 60 (i.e., 2 to 60) are possible without departing from the invention. Generally, a lower even number of members, such as 2, 4, 6, or 12, is preferred.

The face 15 has a perimeter 33 which is comprised of the individual peripheries of the members and may vary greatly in terms of size and shape. The size of the perimeter will be determined by the intended use of the invention, for example, a wristwatch will have a perimeter which is substantially smaller than that of a wall clock. On the other hand, there is an endless assortment of shapes which can be constructed by varying the number of members and their respective peripheries, the selection of which are generally a matter of artistic preference. As illustrated in the drawings, 12 members has been found to be the most advantageous at this time.

Each member of the face 15 includes a first plane 60 and a second plane 65 which are substantially perpendicular to one another and intersect to form a common edge 50. To form the surface of the face 15, the second plane of one member intersects the first plane of an adjoining member to form a common edge 55. These edges define the boundaries of the planes, which in turn comprise the stepped feature of the watch face. Each step defines the difference in height between the first plane of one member and the first plane of an adjoining member at any point along the radial boundary therebetween. Subsequently, each step has a substantially triangular shape which is a function of the radial distance from the central portion or stem 45 along the boundaries, the angle of the first plane of a member with respect to the horizontal, the angle of the second plane with respect to the first and the number of time intervals represented. Accordingly, each of these parameters may be varied, within reason and with respect to the intended use of the invention, to enhance the visual and aesthetic qualities of the steps formed thereby.

In this respect, the angle which the first plane 60 forms may vary from ten to sixty degrees with respect to the horizontal, however, the preferred angle ranges from ten to thirty degrees. In addition, the angle which the second plane 65 forms with respect to the first may be varied either to maintain perpendicularity with it as it varies or independently thereof to approach the vertical plane. Depending upon the angle which the second plane forms with respect to the first, the boundaries of the step formed thereby may either appear as two angled lines converging toward the central point or, in the case where the second plane is vertical, as one single line, when viewed from above. Once again, the angle between the two planes of a member and the subsequent formation of the steps thereby are not critical to the functional design but are a matter of artistic preference. However, the variation in the size of the perimeter of the face 15 and the number of time intervals, which also determine the size and shape of the steps, are intrinsic to the functional purpose of the invention and depend on its intended use. For example, a wristwatch has a limit as to its size and, therefore, the number of time intervals which may reasonably be employed.

The steps formed by the intersection of the planes converge from the periphery of the respective members toward the central portion or stem 45. In this illustration, these steps converge to the central portion, however, this is not essential to the design. For example, these steps may terminate at predetermined distances from the central portion to define a closed area, such as a circle, a rectangle or any other shape to further enhance the aesthetic value of the watch. The enclosed area also may be used to include other functions, such as day, date, calendar, calculator or the like.

The crystal 20, which may be made of transparent plastic or glass or other well known materials, is attached to the face 15 of the watch 10 to protect the hands and the surface of the face from external sources. The perimeter of the crystal 20 corresponds to that of the face 15 in size and shape and the bottom or base of its periphery is provided with a saw-toothed design. This design is coordinated with the stepped configuration of the face, therefore comprising a mating surface for gluing. Press fitting or other means of fastening the crystal may also be employed and, in some cases, for clock design, for example, the crystal may be omitted.

Situated between the upper surface of the face 15 and the bottom surface of the crystal 20 are the hour 25, minute 30 and second 35 hands. These hands are securely attached to a stem 45 and are driven by any suitable clock mechanism such that they rotate around the face 15 relative to the members. The position of these hands, at any instant, relative to the members and the orientation of the face will indicate time.

While hands are shown on the drawing as the preferred method of indicating time, it may be seen that other time indicating means are available for example, the invention may be provided with at least one hand and a light for sequentially illuminating the members. In this embodiment, the illuminated member(s) would represent the present hour, while the hand would move relative to the members to indicate the minute. Other combinations of hands and illumination means may also be used. For example, a portion of the member, such as a circle or square ornament placed near the end, could be illuminated to designate the hour.

In addition to hands or illuminating means, numerals or other indicia may be incorporated on the face to assist in deciphering the time. Such indicia would include jewels, posts, circles, hemisphere, rectangles, triangles, etc., placed at a conspicuous location generally near the outer periphery of each or most of the members 28. While such symbols may increase the ease of telling time, they may also detract from the aesthetic simplicity of the current design.

The invention also has a pair of posts 40 provided opposite to one another along the perimeter of the face to allow for the attachment of a watchband. Further, instead of the posts or, in addition to them, the invention may be equipped with other means of support depending upon the intended use as a wall clock or pendant, for example.

It may also be seen that a wide variety of colors and materials are available for use in the manufacturing of the face 15 and hands. For example, the face may be manufactured out of a transparent material to allow the internal mechanism of the watch to be viewed. A translucent material could be used where the members 28 are to be illuminated. Or, the hands, numbers, or portions thereof, may be coated with a luminous material allowing them to be read in the dark. The selection of color and material is a matter of artistic preference and is not critical to the invention.

Another application of this invention is a specific embodiment for use by the blind or visually impaired. In such an embodiment, either the crystal 20 is omitted or it is attached to the face with a hinge so that it may be rotated away from the face 15. Either configuration will allow access to the members which will be configured so that they are readily discernible by touch. Also, the watch will be provided with at least one raised indicia for orientation of the face, e.g., to designate the "o'-clock" position. To decipher time by the sense of touch, the fingers will travel about the face 15 to locate the hands, the corresponding members and their position relative to the raised reference indicia.

FIGS. 4–8 illustrate the invention in the form of a clock. Although no cover or crystal is shown, it is clear that such can also be used, if desired.

Figure 4:
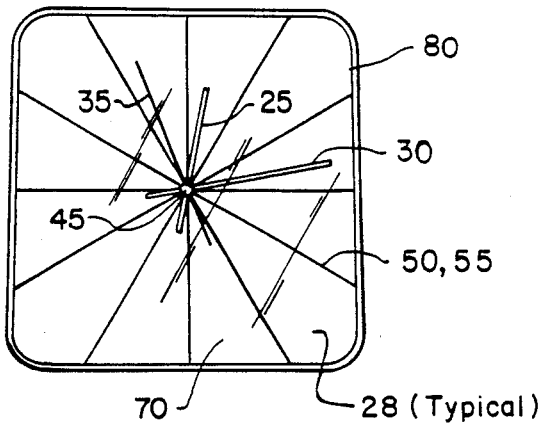
FIG. 4 is a front view of a clock having a face according to the invention with a substantially rectangular perimeter.

FIG. 4 illustrates an embodiment comprising a face 70 whose perimeter is substantially rectangular. The corners 80 of this rectangular may either be rounded, as shown, or square. Also, in this illustration, the second plane 65 of each member is substantially vertical in which case the edges 50 and 55 appear as one line when viewed from above. The angle of the second plane with respect to the first plane is not critical and can vary over a wide range.

Figure 5:
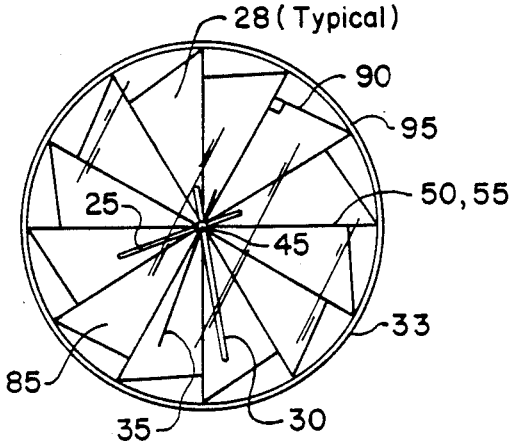
FIG. 5 is a front view of a clock having another face according to the invention this time having a circular perimeter and a serrated pattern.

FIG. 5 demonstrates an embodiment in which the boundary of the first plane of each member forms a shape which is substantially triangular 90 and in which the perimeter of the face 85 is circular. The radius of the circle is defined as the farthest point from the center along the boundary of the first plane.

Figure 6:
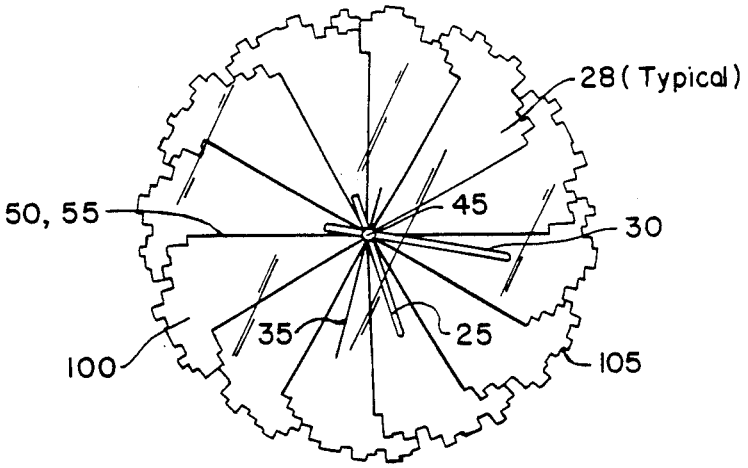
FIG. 6 is a front view of a clock illustrating yet another embodiment of the invention featuring a face having stepped perimeter.

FIG. 6 illustrates an additional embodiment of a clock according to the invention, wherein the periphery of each member offers a slightly different variation on a common pattern which features a series of incremental steps. The perimeter of the face 100 formed by these members is substantially circular. In this embodiment, due to the irregular perimeter, the crystal would either be omitted or employed to cover only a portion of the face without making an attempt to duplicate the perimeter.

Figure 7:
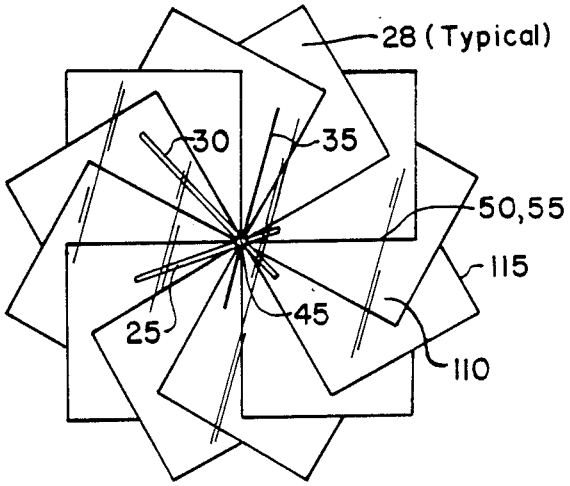
FIG. 7 is a front view of a clock demonstrating a further embodiment of the invention featuring a face having perimeter of a twelve pointed star.

FIG. 7 depicts a series of rectangular members arranged in a stepped configuration about the center point. The resulting perimeter of the face 110 is a twelve pointed star shape. Again, it may be advantageous to omit the crystal 115 or to make use of a crystal which covers only a portion of the face.

Figure 8:
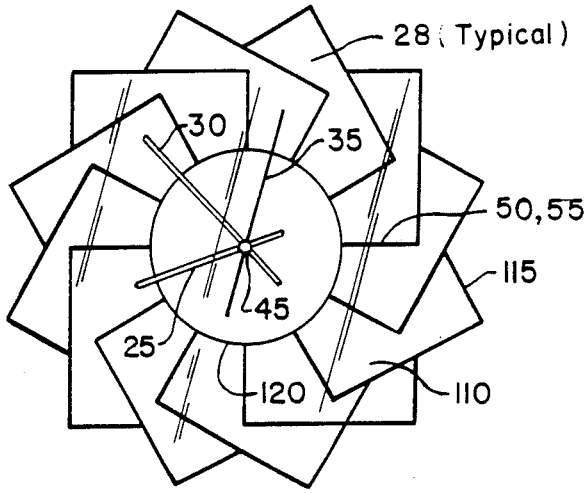
FIG. 8 is a front view of a clock similar to that of FIG. 7 but having an internal flat circular shape.
Figure 9:
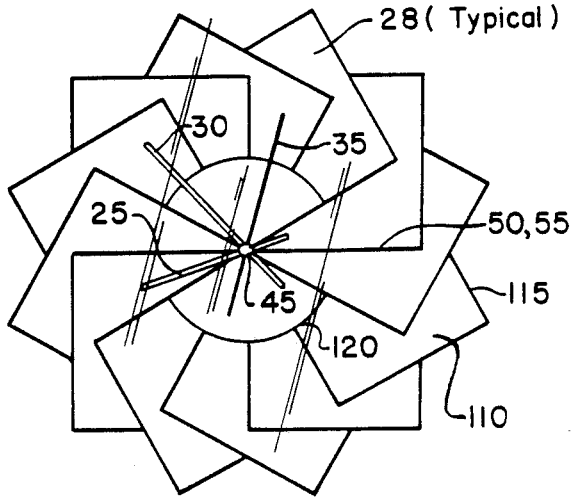
FIG. 9 is a front view of a clock similar to that of FIG. but having a different internal shape.

FIG. 8 exhibits an alternative embodiment to the clock of FIG. 7. The edges 50 and 55 of the members 28 converge toward the central portion 45 but terminate at predetermined distances from said point thereby comprising a closed area 120 in the form of a circle. This alternative design may be applied to any of the previously mentioned embodiments and may take any form selected by the manufacturer.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. An apparatus for indicating time comprising:

(a) a face having stationary members positioned in adjacent relation at an angle with respect to a horizontal base plane and arranged in a predetermined pattern oriented around a central point, each said member comprising a first plane and a second plane which intersect to form a common edge therebetween, said first and second planes being of different areas and terminating in a first plane boundary and a second plane boundary, respectively, wherein the boundary of the first plane of one member contacts a portion of the boundary of the second plane of an adjacent member to form a continuous surface around said point; and (b) means for determining elapsed time by viewing said surfaces.

2. The apparatus of claim 1, whereby said members each represent predetermined time intervals.

3. The apparatus of claim 2 wherein twelve members are utilized, each representing a five minute time interval.

4. The apparatus of claim 3 wherein said time determining means comprises a pair of hands which move relative to said members whereby the position of said hands relative to said members will indicate time.

5. The apparatus of claim 3 wherein said time determining means comprises means for illuminating said members.

6. The apparatus of claim 3 wherein said time determining means comprises at least one hand and means for sequentially illuminating said members, whereby the illuminated member indicates the hour of the day and the hand moves relative to said continuous surface to indicate the minute of the hour.

7. The apparatus of claim 4 further comprising a crystal attached to said surface for protection of said time determining means.

8. An apparatus for indicating time comprising:

(a) a face having stationary members representative of predetermined time intervals relation at an angle with respect to a horizontal base plane and arranged in a predetermined pattern oriented around a central point, each said member comprising a first plane and a second plane which intersect to form a common edge therebetween, said first and second planes terminating in a first plane boundary and a second plane boundary respectively, wherein the boundary of the first plane of one member contacts a portion of the boundary of the second plane of an adjacent member to form a continuous surface around said point; and (b) means for determining elapsed time by viewing said surfaces;

wherein the members terminate at an exterior periphery to which the periphery of said crystal corresponds, and wherein the bottom of the periphery of said crystal has a saw-toothed configuration for mating and engaging with said surface.

9. The apparatus of claim 4 which further comprises means for attachment of said face to a support member.

10. The apparatus of claim 9 wherein the attachment means comprises a pair of posts for mounting a watchband thereto.

11. The apparatus of claim 4 wherein each of the edges between the first and second planes converges radially toward and to said central point.

12. The apparatus of claim 4 wherein each of the edges between the first and second planes converges radially toward said central point but intersects with and terminates at a shape at a predetermined distance from said point.

13. The apparatus of claim 4 wherein the pattern formed by the intersection of the peripheries of said members comprises a perimeter for said continuous surface which is substantially circular.

14. The apparatus of claim 4 wherein the pattern formed by the intersection of the peripheries of said members comprises a perimeter for said continuous surface which is substantially rectangular.

15. The apparatus of claim 14 wherein the edges of said substantially rectangular perimeter are rounded.

16. An apparatus for indicating time comprising:

(a) a face having stationary members positioned in adjacent relation at an angle with respect to a horizontal base plane, and arranged in a predetermined pattern representing time intervals oriented around a central point, each said member comprising a first plane and a second plane which intersect to form a common edge therebetween, said planes being of different areas and terminating in a first plane boundary and a second plane boundary, respectively, wherein the boundary of the first plane of one member contacts a portion of the boundary of the second plane of an adjacent member to form a continuous surface around said point, wherein said common edges converge radially toward said central point and wherein the pattern formed by the intersection of the peripheries of said members comprises a perimeter for said continuous surface;

(b) means for determining elapsed time by viewing said surface; and (c) means for attachment of said face to a support member.

17. The apparatus of claim 16 wherein twelve members are utilized, each representing a five minute interval.

18. The apparatus of claim 17 wherein said time determining means comprises a pair of hands which move relative to said members whereby the position of said hands relative to said members will indicate time.

19. The apparatus of claim 17 wherein said time determining means comprises means for illuminating said members.

20. The apparatus of claim 17 wherein said time determining means comprises at least one hand and means for sequentially illuminating said members, whereby the illuminated member indicates the hour of the day and the hand moves relative to said continuous surface to indicate the minute of the hour.

21. The apparatus of claim 18 further comprising a crystal to protect said surface, the periphery of which has been configured to correspond to the perimeter of said face and the bottom of which has a saw-toothed configuration for mating and engaging said surface.

22. The apparatus of claim 18 wherein the attachment means comprises a pair of posts for engaging a watchband.

23. The apparatus of claim 18 wherein said edges converge radially toward and to said central point.

24. The apparatus of claim 18 wherein said edges converge radially toward said central point but intersect with and terminate at a shape at predetermined distances from said central point.

25. The apparatus of claim 18 wherein said perimeter is substantially circular.

26. The apparatus of claim 18 wherein said perimeter is substantially rectangular.

27. The apparatus of claim 26 wherein the edges of said substantially rectangular perimeter are rounded.

28. An apparatus for indicating time comprising:

(a) a face having stationary members positioned in adjacent relation at an angle with respect to a horizontal base plane and arranged in a predetermined pattern representing five minute time intervals oriented around a central point, each said member comprising a first plane and a second plane being of different areas which intersect to form a common edge therebetween and which terminate in a first plane boundary and a second plane boundary, respectively, wherein the boundary of the first plane of one member contacts a portion of the boundary of the second plane of an adjacent member to form a continuous surface around said point in the form of steps, wherein said common edges converge radially toward said central point and wherein the pattern formed by the intersection of the peripheries of said members comprises a perimeter for said continuous surface;

(b) a pair of hands which move relative to said members whereby the position of said hands relative to said members will indicate time; and (c) a pair of posts for mounting a watchband thereto.

29. The apparatus of claim 28 further comprising a crystal to protect said hands, featuring a saw-toothed configuration on the bottom of its periphery which is configured to correspond to the perimeter of said face, for mating and engaging said continuous surface.

30. The apparatus of claim 28 wherein said edges converge radially toward and to said central point.

31. The apparatus of claim 28 wherein said edges converge radially toward said central point but intersect with and terminate at a shape at predetermined distances from said central point.

32. The apparatus of claim 28 wherein said perimeter is substantially circular.

33. The apparatus of claim 28 wherein said perimeter is substantially rectangular.

34. The apparatus of claim 33 wherein the substantially rectangular perimeter has rounded edges.

* * * * *